United States Patent [19]

Kleine

[11] Patent Number: 4,616,117

[45] Date of Patent: Oct. 7, 1986

[54] DOUBLE POLE CIRCUIT BREAKER

[75] Inventor: Heinz Kleine, Marienheide-Müllenbach, Fed. Rep. of Germany

[73] Assignee: Square D Starkstrom GmbH, Marienheide-Rodt, Fed. Rep. of Germany

[21] Appl. No.: 770,640

[22] Filed: Aug. 28, 1985

[30] Foreign Application Priority Data

Sep. 1, 1984 [EP] European Pat. Off. ..... 84110419.3

[51] Int. Cl.[4] ..... H01H 3/50; H01H 1/02

[52] U.S. Cl. ..... 200/243; 200/250; 200/DIG. 42

[58] Field of Search ..... 200/243, 245, 250, DIG. 42

[56] References Cited

FOREIGN PATENT DOCUMENTS 0050675 10/1980 European Pat. Off. .... 200/DIG. 42

1154553 9/1963 Fed. Rep. of Germany ..... 200/243

1935225 2/1971 Fed. Rep. of Germany .

*Primary Examiner*—Stephen Marcus

*Assistant Examiner*—Renee S. Luebke

*Attorney, Agent, or Firm*—Michael J. Striker

[57] ABSTRACT

A double pole switching device has a plunger which is longitudinally movable in a housing against a spring force and has at least one contact bridge provided with a movable contact switch to operate with immovable contacts, and an element is provided for forcibly opening of adhering or welded contacts and includes a U-shaped bracket with a connecting web located between the contact bridge and a contact pressure spring and two legs cooperating with stepped extensions in the housing so that the bracket and the contact bridge over a first part of the stroke of the plunger are forcibly taken along, and the legs of the bracket over a further part of the stroke are spread outwardly and release the plunger.

8 Claims, 3 Drawing Figures

DOUBLE POLE CIRCUIT BREAKER

BACKGROUND OF THE INVENTION

The present invention relates to a contact device with a plunger which moves longitudinally in a housing against the force of a pressure spring and has one or several recesses, wherein each recess accommodates a contact pressure spring and a contact bridge which extends outwardly beyond both sides of the recess and has movable contact pieces cooperating with the immovable contact pieces so as to form a contact breaker and/or a contact maker. There is further provided a member which cooperates with the contact bridge to force the opening of adhering or welded contacts between the movable and the immovable contact pieces.

Contact devices of the above-mentioned general type are known in the art and are used in connection with different constructions and for different application purposes. They are used for example in huge numbers as end switches. These contact devices have a common feature namely that they are provided with a plunger which is actuated manually or by a drive and serves simultaneously as a contact bridge carrier. In many switching devices of this type, only one contact bridge is available, while in other switching devices several contact bridges are arranged over one another and/or near one another. On the grounds of the switching safety the actuation path of the plunger or contact bridge carrier must be greater than the working stroke of the contact bridge with the movable contact pieces. Moreover, the contact pressure between the movable and immovable contact pieces need not correspond to the actuating force which acts upon the plunger. For this reason, the known contact devices are provided with a pressure spring which returns the plunger after its actuation and holds it in the starting position, or a contact pressure spring is arranged in each recess of the plunger with each contact bridge. These springs determine and exactly adjust the desired contact pressure. Each contact bridge is held under the pressure of the contact pressure spring which is movable in the recess of the plunger.

This arrangement, however, possesses the following disadvantage: during the switching process electric arc or local overheating on the contact points between the movable and the immovable contact pieces can take place, which leads to adhering or local welding of the contact pieces. During actuation of the plunger one or another movable contact piece can be caught, and either the contact does not open at all or opens only after the travel of the contact bridge over a greater part of the working stroke. As a result of this malfunction the contact bridge becomes inclined and can cause tearing off of the adhered or welded points. In view of these considerations, the known contact devices do not have a sufficient switching reliability.

In German publication DE-B No. 1 935 225 there is disclosed a contact device which is formed as an electrical snap switch. In this construction, a turning lever extending at both sides of the actuating plunger is rotatably supported by pins in the housing of the snap switch. The ends of a turning lever extending toward the actuating plunger can engage in depressions of the actuating plunger, and the depressions are limited by inclined surfaces. Turning of the turning lever is performed so that the ends of the turning lever during actuation of the actuating plunger are first moved into the depressions, and then abut against the inclined surfaces. As a result of the thus produced turning movement, the other ends of the turning lever come into contact with the contact bridge. During further movement of the actuating plunger, the contact supports of the contact bridge are separated from the fixed contact pieces. In the event of adhering or welded contacts a forced separation is performed. The forces required for the forced separation act upon the movable contact parts relatively close to the contact point. Because of the support of the turning lever by means of fixed pivot pins in the housing, a movement reverse takes place or in other words the lever ends acting on the contact bridge are moved in a reverse direction to the actuating plunger and the contact bridge is displaced in the reversed direction. This reversal of the movement direction is in agreement with the movement conditions of the snap switch and is achieved by the construction of the contact bridge of three parts including a central tongue and two outer tongues. The reversal of the movement direction is however also performed in the case of a rigid contact bridge. Moreover, in the known construction a considerable movement play is provided and required, until it comes to a forced separation of the contact. Thereby, unfavorably great inclined positions of the contact bridge at one or other end are produced. Finally, a forced separation of the contact is provided only for the contact breaker contacts and not for the later opening of the contact maker contacts.

A further contact device is disclosed in the EU-A No. 005 0675. In this construction the structural members are seated on the contact bridge parts extending beyond the recess of the plunger and formed by outwardly trapezoidally reducing blocks which are turnable in a small angular region relative to the direction of displacement of the plunger. A projection is provided on the inner side of each block and engages in the recess. The inclined surfaces of the trapezoidal block cooperate with the inner edges and/or inner inclined surfaces of the housing so that each projection after a part of the displacement path of the plunger disengages from the recess. This contact device has the advantage that the forced opening of the contact is practically performed without any delay, or in other words, without previous great movement play. It is further achieved here that the respective movement direction of each contact bridge corresponds to the movement direction of the plunger.

SUMMARY OF THE INVENTION

Accordingly, it is an object of the present invention to provide a contact device which requires a very low material and manufacturing expenditures and is suitable especially for mass production.

In keeping with these objects and with others which will become apparent hereinafter, one feature of the present invention resides, briefly stated, in a contact device in which the member for forced opening of adhering or welded contacts is formed as a U-shaped bracket with a web located between a contact bridge and a pressure spring and two legs cooperating with stepped extensions in neighboring housing surfaces so that the bracket and the contact bridge are forcibly taken along over a first part of the stroke of the plunger, and the legs of the bracket over a further part of the stroke spread outwardly and release the plunger.

When the contact device is designed in accordance with the present invention, it achieves the above-mentioned objects.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
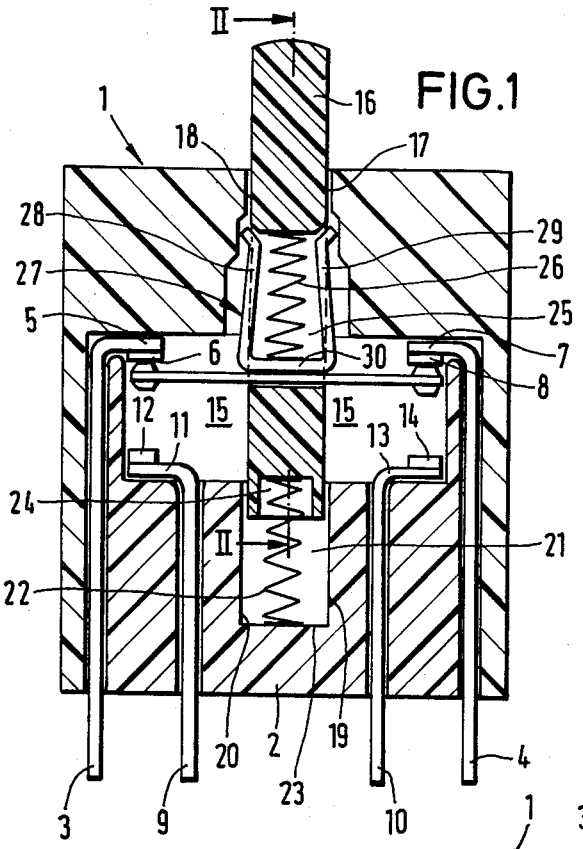
FIG. 1 is a view showing a longitudinal section of a contact device in accordance with the present invention, in a rest position.
Figure 2:
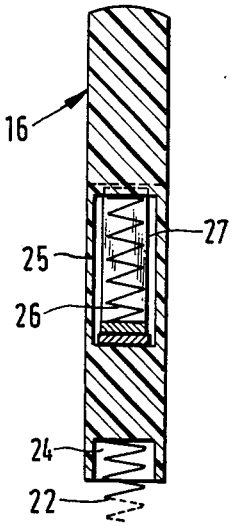
FIG. 2 is a view showing a section of a plunger of the inventive contact device, taken along the line II—II in FIG. 1.

An example of a contact device in accordance with the present invention is shown in a simplified manner and has a housing 1 and a housing insert 2 which are designed so as to enable simple assembling of all individual parts of the device.

The device has two outer fixed contact closing bars 3 and 4, and two inner also fixed contact closing bars 9 and 10. The contact closing bars 3 and 4 have ends 5 and 7 which are bent inwardly and carry fixed contact pieces 6 and 8 on their lower side. The contact closing bars 9 and 10 have ends 11 and 13 which are bent outwardly and carry fixed contact pieces 12 and 14 on their upper surface.

A substantially rectangular switching chamber 15 is formed between the housing 1 and the housing insert 2. A contact bridge 39 is movably arranged in the switching chamber 15. A plunger 16 moves longitudinally in the housing 1 and housing insert 2. For this purpose, the housing 1 is provided with guides 17 and 18, while the housing insert 2 is provided with guiding surfaces 19 and 20. The path of displacement of the plunger 16 can be limited by not shown abutments at its both sides.

The housing insert 2 has a recess 21 in which the above-described guides 19 and 20 are formed. A pressure spring 22 is accommodated in the recess 21 and abuts with its one end against a bottom 23 of the recess 21 and with its other end against an inner surface of a recess 24 in the lower end of the plunger 16. In the shown example the plunger has a substantially rectangular through-going recess 25. A contact pressure spring 26 extending in the direction of displacement of the plunger 16 is arranged in the recess 25 and formed in the shown example as a helical spring. Furthermore, the movable contact bridge 39 is located in the recess 25 under the lower end of the contact pressure spring 26. The contact bridge 39 extends at both sides outwardly beyond the recess and is provided at the ends and also on the upper surface and the lower surface with movable contact pieces 40 and 42, and 41 and 43 which are designed so that they form with the above-described fixed contact pieces contact breakers and/or contact makers.

Figure 3:
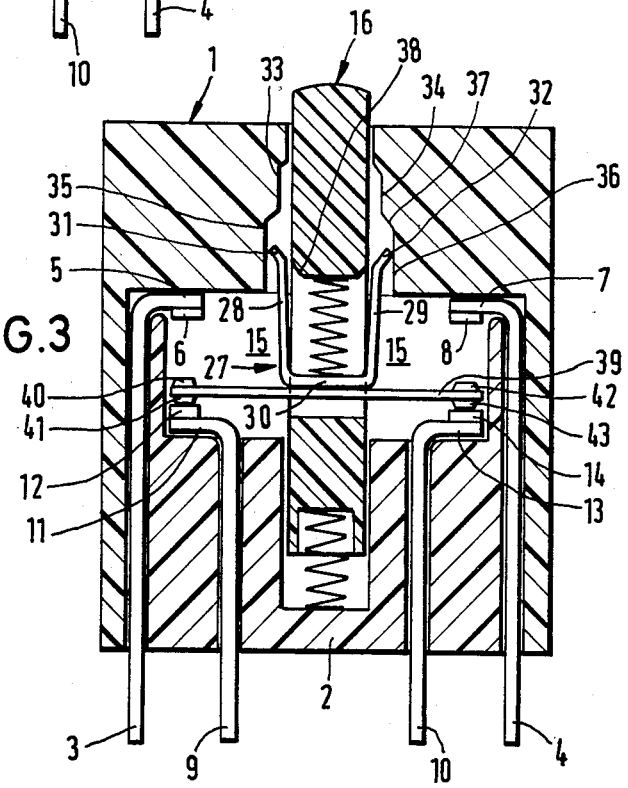
FIG. 3 is a view showing a longitudinal section corresponding to the section of FIG. 1, but showing the contact device in an actuated position.

An upwardly open U-shaped bracket 27 is arranged in the recess 25. The bracket 27 has a horizontal web 30 and two upwardly extending legs 28 and 29. The web 30 is located between the contact bridge 39 and the lower end of the contact pressure spring 26. The legs 28 and 29 have upper outer ends 31 and 32 which advantageously are bent outwardly. In the rest position of the plunger 16 shown in FIG. 1, and also during a first part of the subsequent plunger stroke they lie on neighboring edges 38 of the plunger which are formed by the recess 25. Advantageously the edges 38, as shown especially in FIG. 3, extend at an angle of approximately 30°–50° to the direction of movement of the plunger 16 and in some cases are also rounded.

In the region between the switching chamber 15 and the guide 17, 18 of the housing 1, two stepped extensions 33 and 35 and 34 and 36 are arranged so that they follow one another in the direction of movement of the plunger 16 and are located at both sides of the latter. Transition surfaces 37 between the extensions are inclined at an angle approximately 30°–50° relative to the direction of movement of the plunger. The respective surfaces of the extensions 33, 34, 35, 36 extend parallel to the direction of movement of the plunger.

Advantageously, the bracket 27 is composed of a springy elastic material, for example, spring steel or in some cases brass or the like and in the rest position shown in FIG. 1 is deformed so that the subsequent spreading of the legs 28, 29 during the movement stroke of the plunger is performed against the inherent spring forces. For preventing lateral displacement of the bracket 27 and the contact bridge 39 respective holding means can be provided between the respective positions of the plunger 16 as well as the bracket and the contact bridge. For example, corrugations or fin-shaped projections and openings engage in one another, or grooves and guiding strips on limiting surfaces of the recess 25 extend parallel to the surface of the drawing in FIG. 1.

The operation of the above-described contact device is performed as follows:

When the plunger 16 is actuated or in other words is moved from the rest position shown in FIG. 1 downwardly, the bracket 27 is forcibly taken along over a first part of the stroke of the plunger, since the inclined outwardly extending bent ends 31 and 32 of the legs 28 and 29 of the bracket abut against the edges 38 of the plunger and the extensions 33 and 34 are dimensioned so that the legs of the bracket cannot deviate outwardly. Thereby the contact bridge is also taken along forcibly, so that eventually adhering or welded contacts are forcibly opened. As long as the plunger 16 is moved downwardly so that the bracket ends 31, 32 reach the region of the extensions 35 and 36, the legs 28 and 29 of the bracket 27 are spread outwardly since these extensions 35 and 36 have a greater width and particularly such a width that the outwardly spread legs of the plunger 16 are released for a further movement downwardly, as can be seen from FIG. 3. The contact bridge 39 comes with the movable contact pieces 41 and 43 to abutment against the stationary contact pieces 12 and 14. The contact pressure is determined by the contact pressure spring 26 and not by the force which is applied upon the plunger 16. The plunger 16 can finally be moved further without impediment for the remaining part of the stroke. With the releasing of the plunger, the pressure spring 22 causes a return movement of the movable parts to the rest position shown in FIG. 1. Thereby, the ends 31 and 32 of the legs 28 and 29 of the bracket 27 slide along the surfaces of the extensions 35 and 36. As long as they reach the inclined surfaces 37, they are bent by these inclined surfaces on the one hand, and also by the inherent spring force on the other hand back until the ends of the legs abut again, as described, against the edges 38 of the plunger.

It is to be understood that the above described housing construction can be formed differently. The housing can be composed for example of two different halves or housing parts which are formed with separating plane extending normally to the plane of the drawings or parallel to the plane of the drawings of FIGS. 1 and 3. The contact closing parts 3, 4, 9 and 10 can also be formed differently, for example both opposite side surfaces can be guided outwardly and there provided with contact closing screws. In the above shown example only one recess 25 is provided in the plunger 16. Instead, several recesses can be formed with inserted contact bridges, U-shaped brackets and the like, near one another and/or over one another in a single plunger In this case, there is a joint contact bridge holder. The contacts can be formed selectively as contact braker or contact maker.

In the above shown example the housing 1 has a housing insert 2. Instead, the housing can advantageously be formed as a single block, or in other words, the housing insert 2 shown as a separate part, can be formed of one-piece with the housing 1. The contact closing rails 3, 4 and 9, 10 with their stationary contact pieces, for example can be placed in an injection mold and then the housing can be cast in it as a single block.

In the above description difference was made between the stationary contact pieces 6, 8 and 12, 14, and movable contact pieces 40, 41, 42, 43. It is to be understood that the movable contacts are movable only with the contact bridge 39 but are fixed on the latter.

It will be understood that each of the elements described above, or two or more together, may also find a useful application in other types of constructions differing from the types described above.

While the invention has been illustrated and described as embodied in a contact device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A contact device, comprising, a housing; a pressure spring in said housing; a plunger movable in said housing against a force of said pressure spring and having at least one recess; a contact pressure spring arranged in said recess of said plunger; a contact bridge arranged in said recess of said plunger and extending outwardly beyond its both sides; movable contact pieces arranged on said contact bridge; immovable contact pieces arranged so that said movable contact pieces form together with said immovable contact pieces contact breakers and/or contact makers; and a member cooperating with said contact bridge so as to provide a forced opening of adhering or welded contacts between said movable and immovable contact pieces, said member being formed as a U-shaped bracket which has a web extending between said contact bridge and said contact pressure spring, and two legs connected with said web; and formations provided in said housing and formed as stepped extensions, said legs of said bracket and said stepped extensions of said housing being formed so that said bracket and contact bridge over a first part of a stroke of said plunger are forcibly taken along by the latter and said legs of said bracket over a further part of the stroke of said plunger spread outwardly and release said plunger.

2. A contact device as defined in claim 1, wherein said plunger has a plurality of such recesses, said contact bridge and said contact pressure being provided in each of said recesses of said plunger.

3. A contact device as defined in claim 1, wherein said extensions include two stepped extensions arranged near one another in the direction of movement of said plunger at each side of said plunger and having transition surfaces therebetween, said transition surfaces extending at an angle of substantially between 30° and 50° relative to the direction of movement of said plunger.

4. A contact device as defined in claim 1, wherein said housing has surfaces which limit said extensions and extend parallel to the direction of movement of said plunger.

5. A contact device as defined in claim 1, wherein said legs have ends which are bent outwardly, said plunger has edges which are formed by said recess, said ends of said legs being formed so that in an immovable position of the plunger as well as during the first part of the stroke of said plunger they abut against said edges of said plunger.

6. A contact device as defined in claim 5, wherein said edges of said plunger are inclined at an angle of substantially between 30° and 50° relative to the direction of movement of said plunger.

7. A contact device as defined in claim 1, wherein said bracket is formed of a springy elastic material which becomes deformed in a rest position so that spreading of said legs of said bracket takes place against its inherent spring force.

8. A contact device as defined in claim 1, wherein said extensions include two stepped extensions located near one another in the direction of movement of said plunger on each side of the latter, said housing being further provided with guiding surfaces which are arranged for guiding said plunger and connected with said extensions.

* * * * *